US010312029B2

(12) United States Patent
Augustin et al.

(10) Patent No.: US 10,312,029 B2
(45) Date of Patent: Jun. 4, 2019

(54) ILLUMINATED VANDAL-RESISTANT PUSHBUTTON SWITCH

(71) Applicant: STENCIL CUTTING AND SUPPLY CO., INC., Red Wing, MN (US)

(72) Inventors: Tyson J. Augustin, Red Wing, MN (US); Lee C. Kinney, Ellsworth, WI (US); Cole W. Majerus, Goodhue, MN (US)

(73) Assignee: SCS Elevator Products Inc., Red Wing, MN (US)

( * ) Notice: Subject to any disclaimer, the term of this patent is extended or adjusted under 35 U.S.C. 154(b) by 0 days.

(21) Appl. No.: 15/690,512

(22) Filed: Aug. 30, 2017

(65) Prior Publication Data

US 2019/0066943 A1 Feb. 28, 2019

(51) Int. Cl.

| | |
|---|---|
| ***H01H 13/02*** | (2006.01) |
| ***H01H 13/10*** | (2006.01) |
| ***H01H 13/14*** | (2006.01) |

(52) U.S. Cl.

CPC ..... *H01H 13/023* (2013.01); *H01H 13/10* (2013.01); *H01H 13/14* (2013.01); *H01H 2221/036* (2013.01); *H01H 2235/01* (2013.01)

(58) Field of Classification Search

CPC ..... H01H 13/00; H01H 13/023; H01H 13/10; H01H 13/14; H03K 2217/9653

See application file for complete search history.

(56) References Cited

U.S. PATENT DOCUMENTS

| | | | | |
|---|---|---|---|---|
| 4,022,296 | A | 5/1977 | Mandel et al. | |
| 4,419,555 | A * | 12/1983 | Kim | H01H 13/023 200/293 |
| 5,434,377 | A | 7/1995 | Martin et al. | |
| 7,554,047 | B2 * | 6/2009 | Verdu | H01H 13/023 200/314 |
| 8,207,466 | B2 * | 6/2012 | Singh | H01H 13/023 200/329 |
| 8,829,375 | B2 | 9/2014 | Hogan et al. | |
| 9,088,139 | B2 * | 7/2015 | Chu | H02B 1/26 |

* cited by examiner

*Primary Examiner* — Vanessa Girardi

(74) *Attorney, Agent, or Firm* — Dewitt LLP; C. G. Mersereau

(57) ABSTRACT

A pushbutton switch assembly is disclosed which includes a button body housing having a central opening and a mounting ring for mounting in a panel and optionally containing a halo, a pushbutton target system mounted in and operable with respect to the button body housing, a return spring for returning the pushbutton target system to a normal position when it is depressed and released, a base containing a source of illumination for fully lighting the pushbutton target system and any halo and containing one or more microswitches, and wherein the button body housing limits the travel of the pushbutton to just operate the one or more microswitches to prevent damage to components in the base from excessive force.

8 Claims, 9 Drawing Sheets

ILLUMINATED VANDAL-RESISTANT PUSHBUTTON SWITCH

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to pushbutton switch devices and, more particularly, to pushbutton switch devices in which electrical contact is made in a control circuit when the switch plunger is advanced. The switch provides a momentary signal in a circuit that initiates an action which continues after the momentary push of the button has been released. Many coordinated switches may be mounted in a panel array with corresponding pushbuttons such as in elevator controls and, specifically, the switch devices of the invention feature full illumination with a vandal-resistant construction.

II. Related Art

A variety of pushbutton switch devices have been developed in which a target pushbutton is connected to a central plunger system that is longitudinally moveable in a button body to contact, momentarily connect and thereby activate a control circuit upon depressing the plunger against a return compression spring and in which contact is broken upon release and retraction of the pushbutton and plunger. Such switches initiate an action which continues after a momentary push of the button has been released. Such a sequence is well known. For example, in elevator controls where pushbuttons associated with each floor are used to log in and activate the operation of the elevator accordingly.

Pushbutton switches are known which include illumination aspects. Such devices are shown, for example, in U.S. Pat. No. 5,434,377 to Martin et al in which LED illuminating devices are used, and U.S. Pat. No. 8,829,375 to Hogan et al. It is also known to provide switches with a rugged or vandal-resistant construction in locations where they may be subject to abuse.

SUMMARY OF THE INVENTION

The present invention is directed to embodiments of a pushbutton switch assembly having a pushbutton element designed to be depressed and released, the button springing back to a normal position immediately after release. A momentary signal to a circuit provided by the pushbutton is designed to initiate a remote action such as the operation of an elevator rather than just a local result. The pushbutton switch assemblies of the invention combine full illumination with a vandal-resistant construction.

A preferred embodiment includes a base that contains an illuminating LED array and one or more microswitches, a button body housing which may or may not include an illuminated halo is provided with a fixed hollow central barrel and a pushbutton target system is mounted in and operable within the button body housing, the pushbutton being spring biased and longitudinally moveable relative to the housing or button body. A symmetrical compression return spring is mounted in the button body that causes the pushbutton, when depressed and released, to return to an outward or normal position. The button body housing is designed to be mounted in a pushbutton panel and may come with or without a halo aspect.

Illumination is provided by an LED array located in the base of the assembly containing a plurality of LED devices. Light from the LEDs is projected straight up along a centerline to illuminate the pushbutton target and at an angle to illuminate a halo. In this manner, both the target and the halo (if present) may be fully illuminated.

A vandal-resistant or "vandal-proof" aspect is also provided in the design. The pushbutton target system is surrounded by a ring portion of the button body housing with only a narrow gap therebetween such that when the pushbutton target system is depressed, its travel is limited by the ring to just enough to enable contact with the corresponding microswitches. Both the target body and the ring portion are preferably made of stainless steel for added strength. If excessive force is applied to the pushbutton, it is distributed through the stainless steel components and the mounting panel leaving the signaling aspect unaffected.

BRIEF DESCRIPTION OF THE DRAWINGS

In the drawings, wherein like numerals designate like parts throughout the same.

DETAILED DESCRIPTION

The detailed description is intended to present certain exemplary preferred embodiments that illustrate the concepts of the present invention. The embodiments are intended by way of example and are not intended to limit the scope of the invention in any respect. It is further recognized and understood that one skilled in the art might make modifications which remain in keeping with the inventive concepts.

Figure 1:
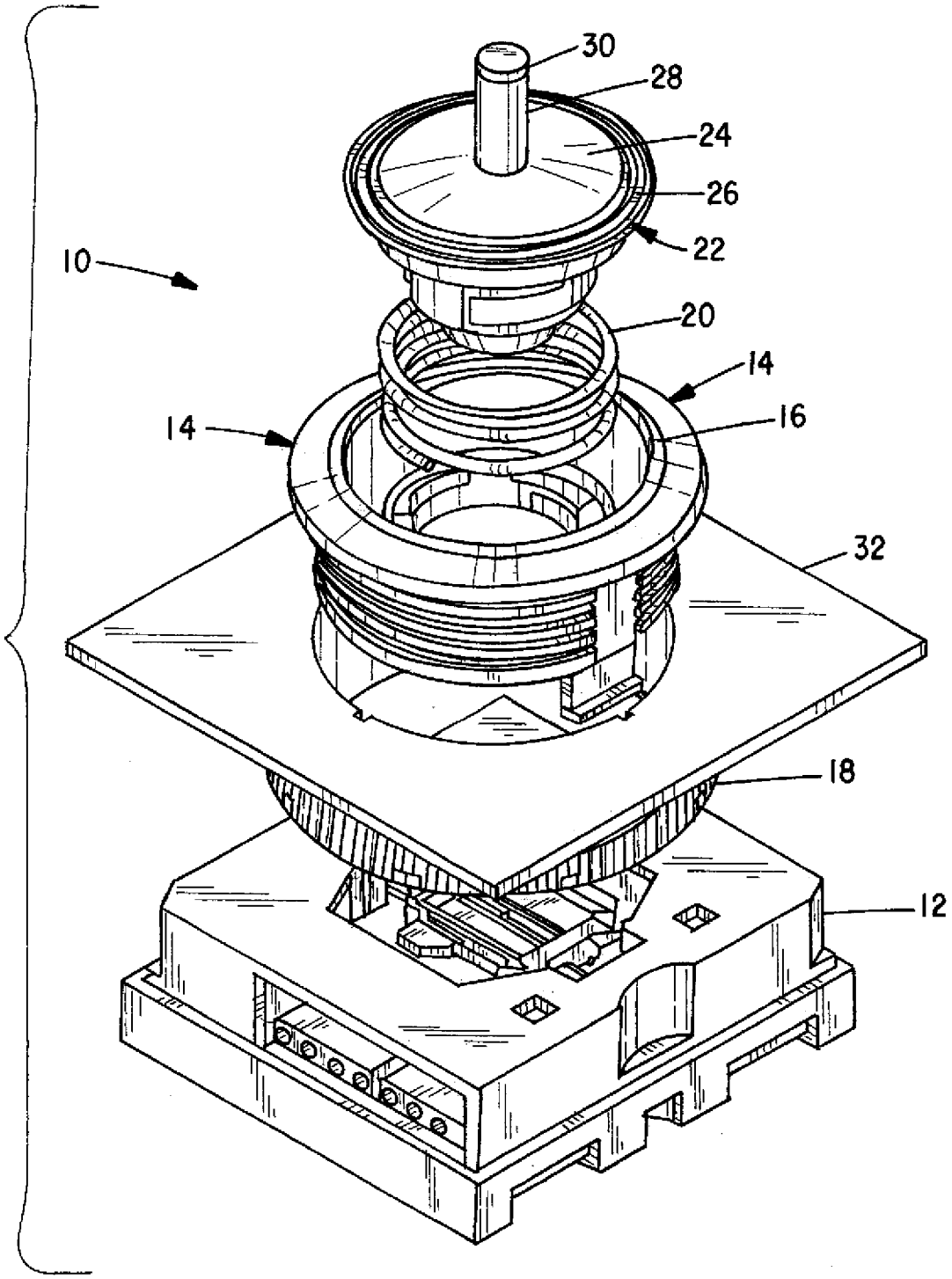
FIG. 1 is an exploded perspective view of a pushbutton switch assembly in accordance with the invention.

FIG. 1 depicts an exploded perspective view of a pushbutton switch assembly embodiment in accordance with the invention. An exploded side elevational view appears in FIG. 2A and a top view appears in FIG. 2B. The embodiment, shown generally at 10, includes an LED and microswitch-containing base 12, a threaded button body housing 14 with illuminated halo at 16. A button body housing nut is shown at 18 and a cylindrical button return compression spring is shown at 20. A pushbutton target system 22 includes a flush domed button 24 with rings 26 and indicator 28 with an indicator jewel 30. A typical panel segment with cutout is shown at 32 illustrating the mounting mode. The cylindrical compression spring 20 is preferably symmetrical so that it can be installed in either direction in the spring seat to avoid any binding issues during an actuating or return stroke.

Figure 2A:
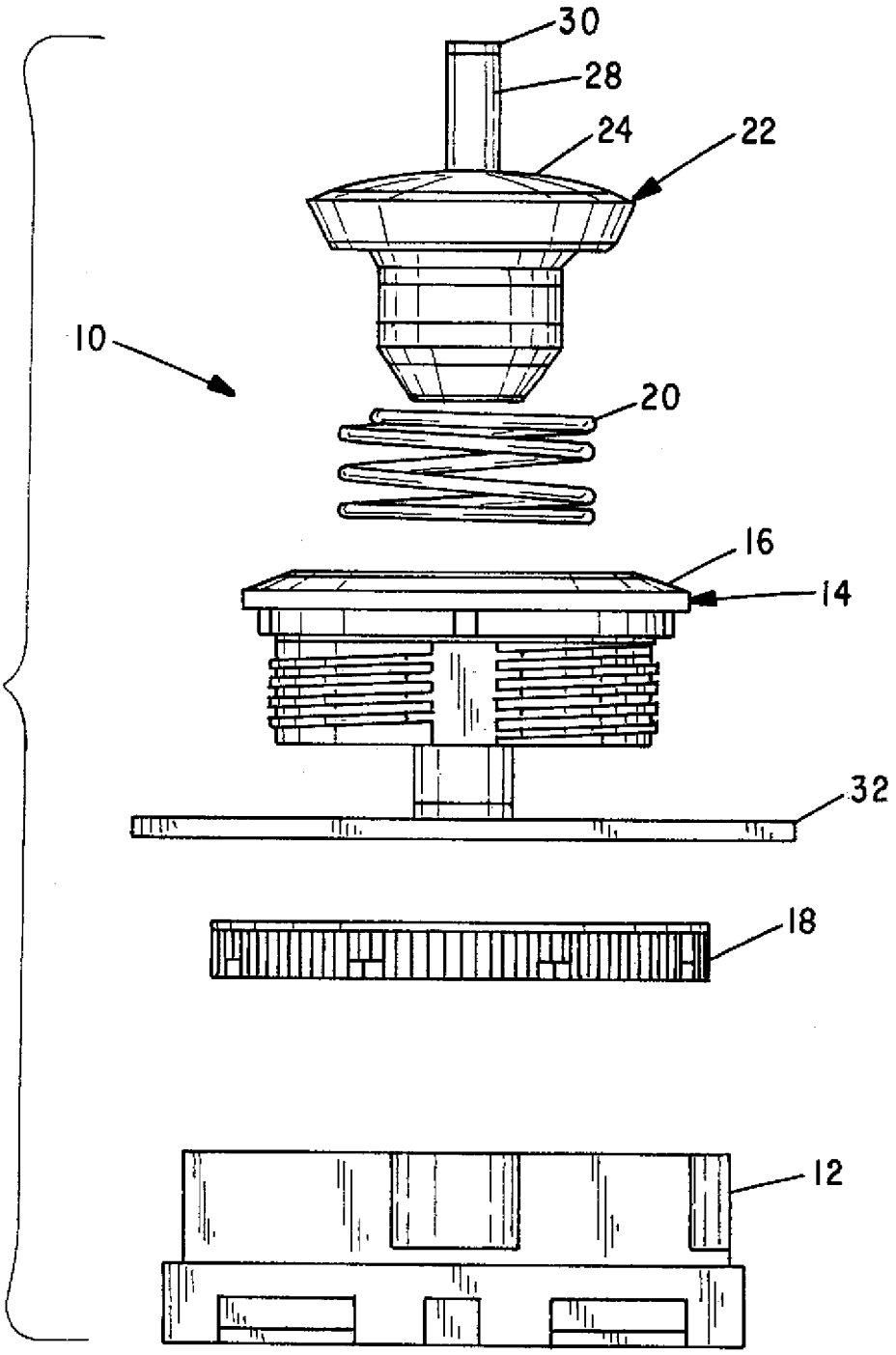
FIG. 2A is an exploded side elevational view of the embodiment of FIG. 1.
Figure 2B:
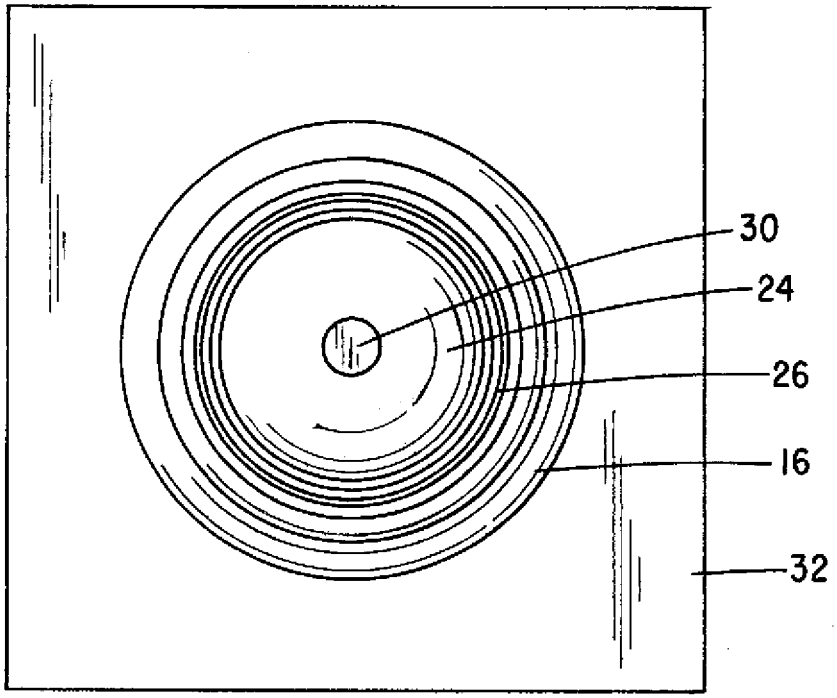
FIG. 2B is a top view of the embodiment of FIG. 2A.
Figure 3A:
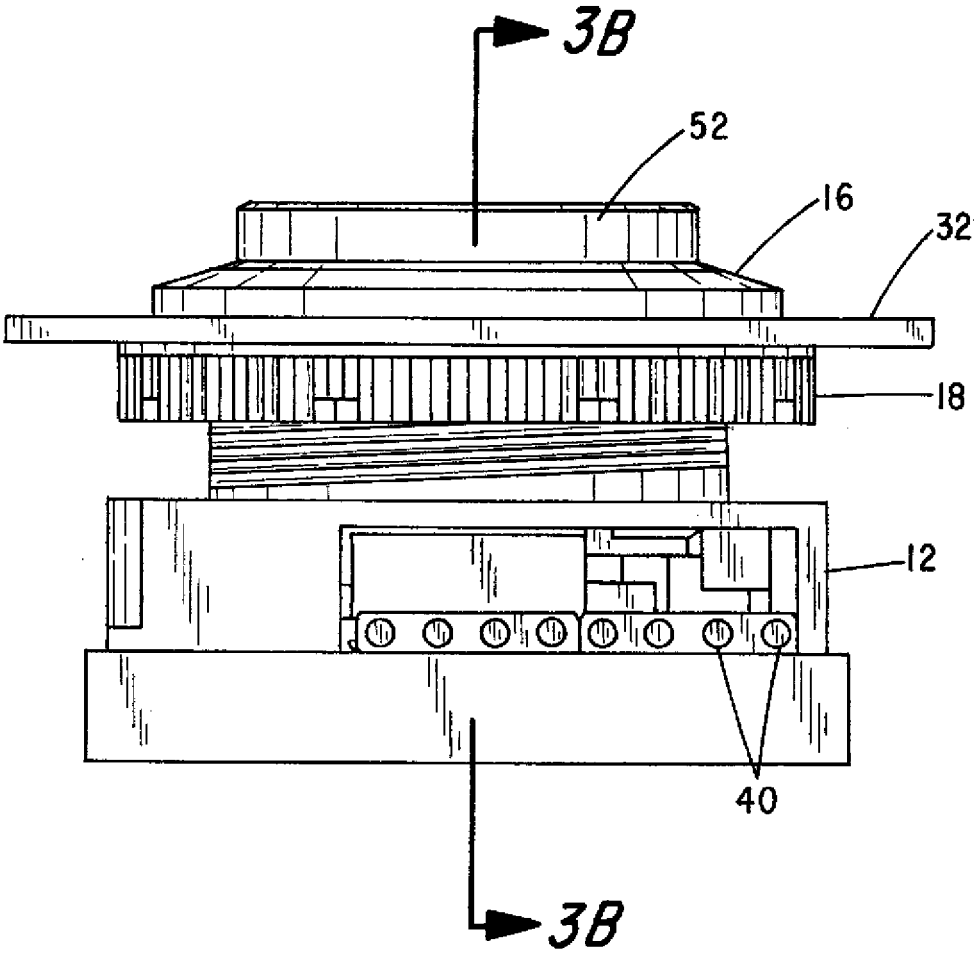
FIG. 3A is an assembled pushbutton switch assembly embodiment similar to that of FIG. 1 with an alternative button body.
Figure 3B:
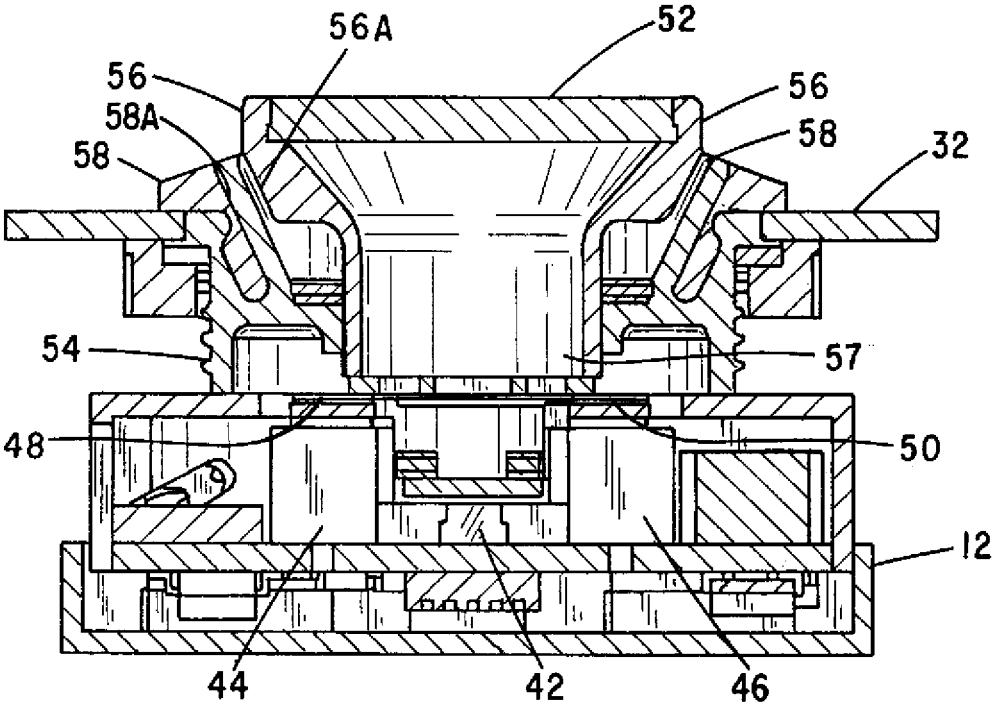
FIG. 3B is a sectional elevational view of the embodiment of FIG. 3A.
Figure 3C:
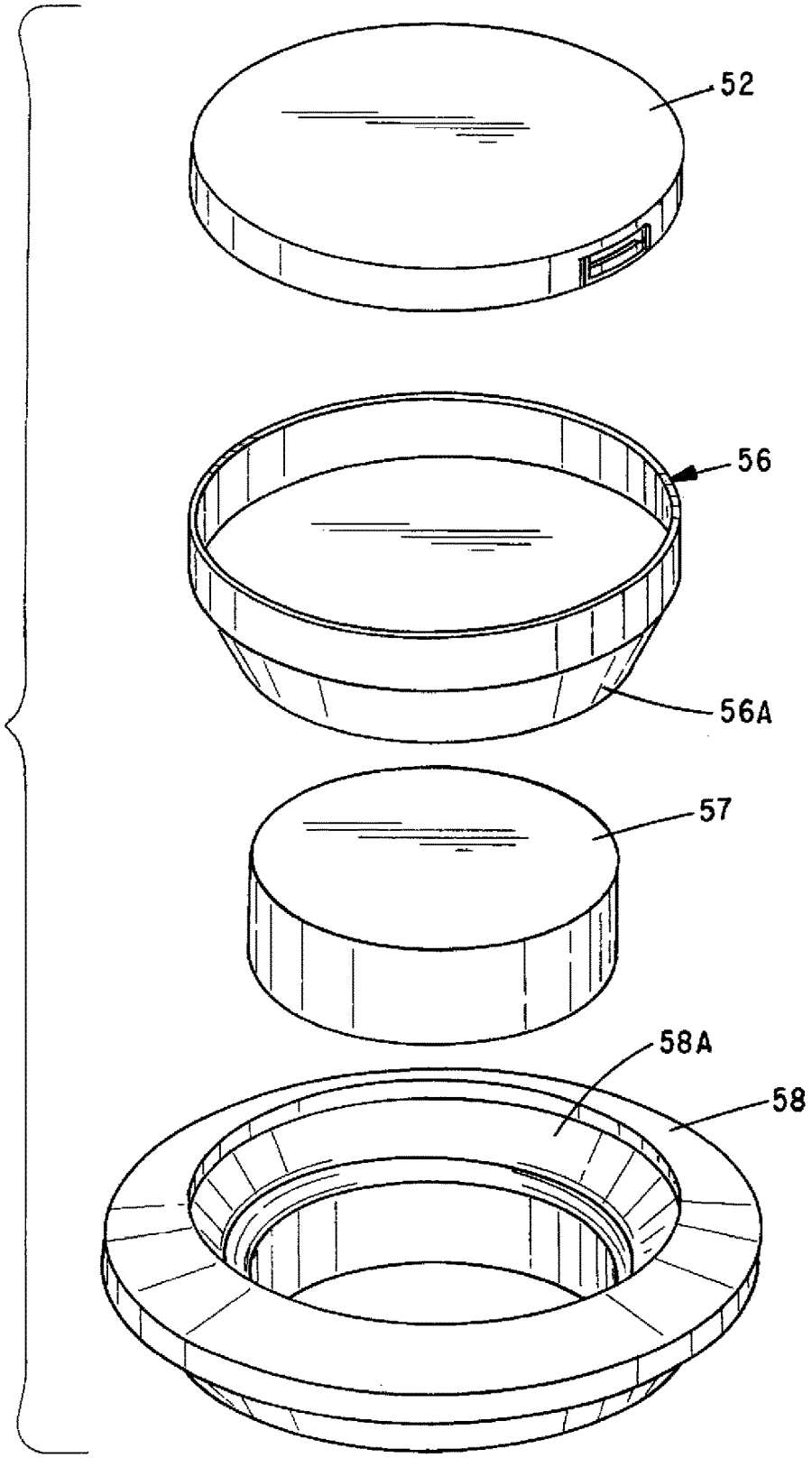
FIG. 3C is a partial exploded view of upper components in FIG. 3B.

FIGS. 3A, 3B, and 3C depict elevational, sectional, and partial exploded views of an embodiment of the pushbutton switch assembly similar to that of FIGS. 1, 2A and 2B with an alternative button body housing and pushbutton target system. A plurality of push-in or plug-in wire connectors are shown at 40. An LED illuminating array is shown at 42. A pair of microswitches 44 and 46 with actuator contact points 48 and 50 are also mounted in the base. A flat or concave pushbutton target is shown at 52 and a button body housing at 54.

The outer surface 56 of the pushbutton target system includes an inclined aspect 56A that is surrounded by a ring member of the button body housing 58 that includes a matching inclined surface 58A. Both of these members are close to each other with only a narrow gap therebetween. In this manner, the travel of the pushbutton target system is limited as it is stopped by or "bottoms out" on the matching surface ring 58 when it is fully depressed such that surface 56A contacts surface 58A. The members 56 and 58 are preferably made of stainless steel to better give the pushbutton assembly a vandal-resistant aspect which is important to the design. Thus, when the target body is fully depressed, the bottom of the target shaft contacts the mating actuator components only to the extent necessary to actuate the microswitch component and this prevents additional force from affecting switch operation. Excessive force applied to the target is distributed and dissipated through the extended contact area of the matching inclined surfaces of the stainless steel components and the mounting panel. The button assembly remains fastened to the panel.

Figure 4:
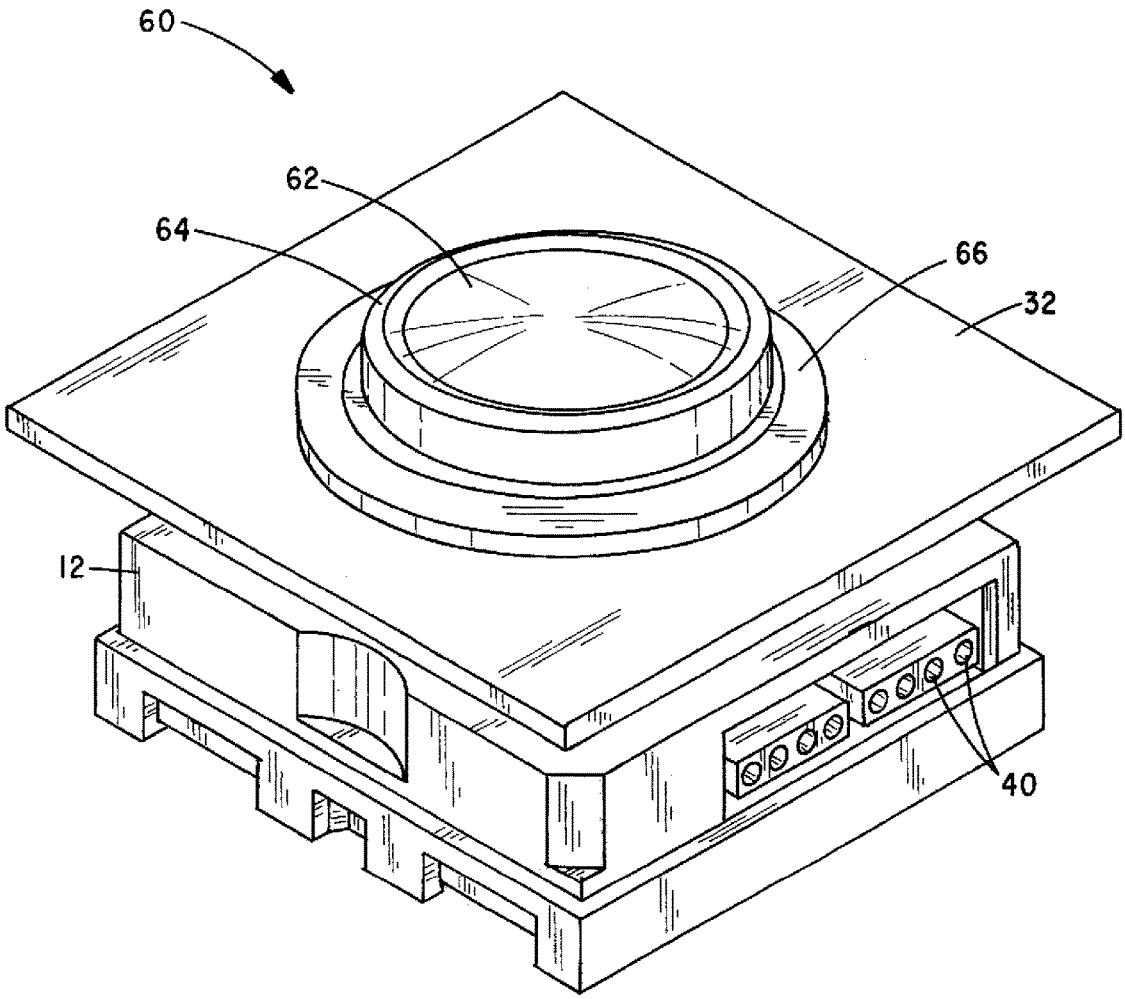
FIG. 4 is a perspective view of an assembled pushbutton switch assembly similar to that shown in FIGS. 3A and 3B.
Figure 5:
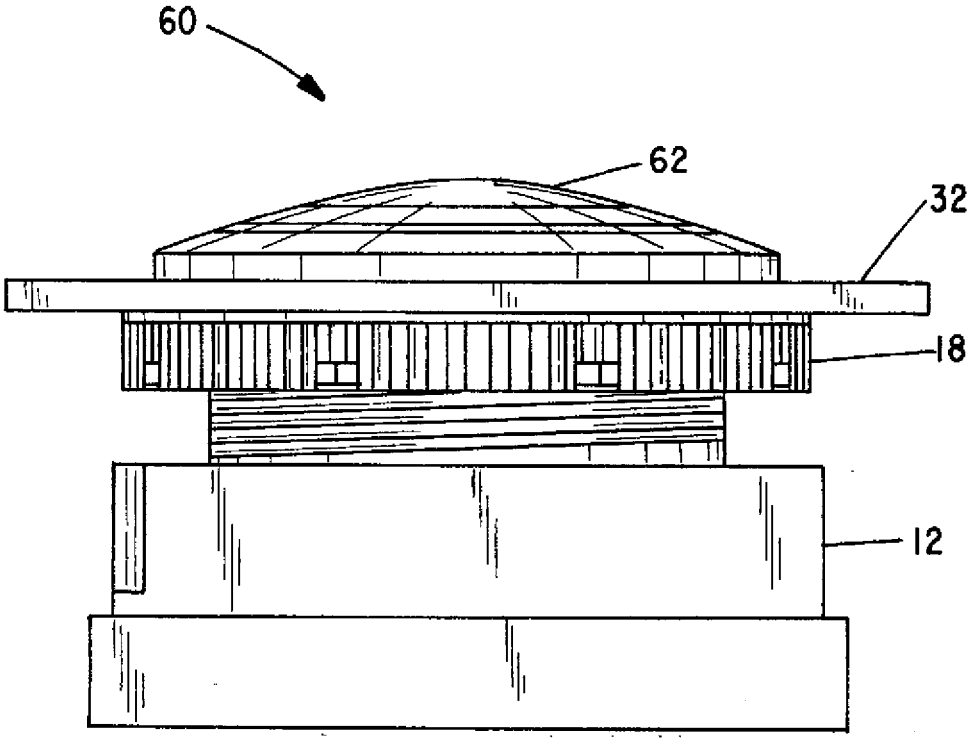
FIG. 5 is a side elevational view of an embodiment with a domed button body.

A slightly different arrangement is shown at 60 in FIGS. 4 and 5 and includes a flush domed target 62 with rings 64 and a halo 66.

Figure 6:
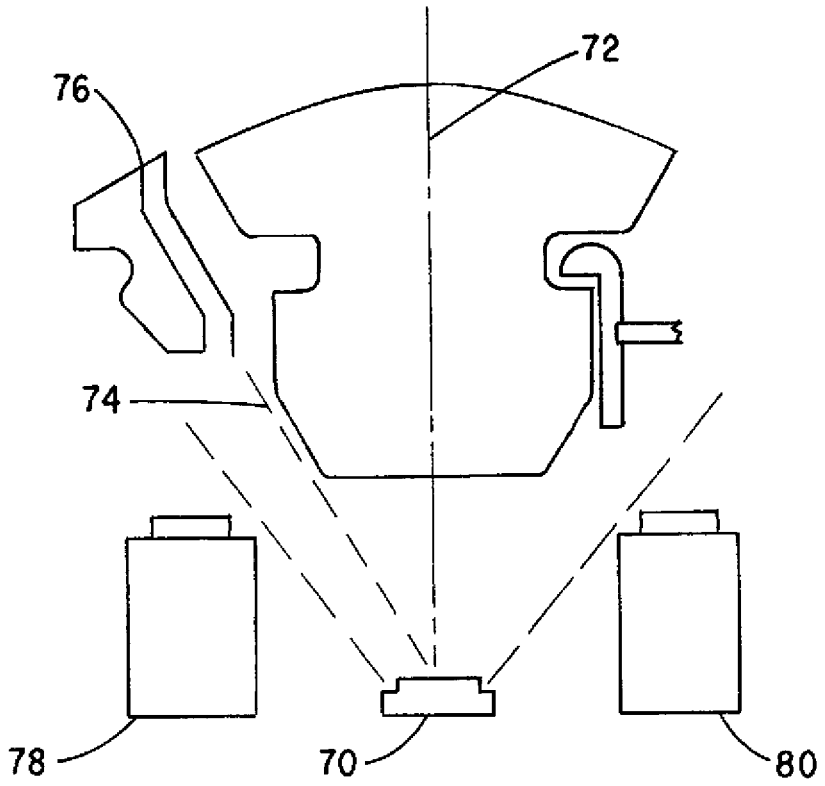
FIG. 6 is a partial schematic partially exploded side view of a pushbutton switch assembly showing an illumination pattern.

A partial schematic partially exploded side elevational view of the pushbutton switch assembly in FIG. 6 diagrams the illumination pattern for a completely illuminated embodiment. An LED array is shown at 70 which contains three or more LED members (not shown). Light is projected straight up to illuminate the target along a center line at 72 and at an angle along lines as at 74 to illuminate a halo at 76. Microswitches with contact points are shown at 78 and 80.

The design of the pushbutton switch assembly allows for the entire surface of the button target to be illuminated as well as an optional outer halo ring while preserving stainless on stainless vandal-resistant aspects in switch operation.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A pushbutton switch assembly comprising:

(a) a button body housing having a central opening and a mounting ring having an inclined inner surface area and an outer portion for mounting said pushbutton switch in a panel and optionally containing a halo;

(b) a pushbutton target system mounted in and operable with respect to said button body housing and having an outer inclined surface area aspect which matches said inclined inner mounting ring surface, a gap existing therebetween such that fully depressing said pushbutton target system produces contact between the inclined surfaces;

(c) a return spring for returning said pushbutton target system to a normal position when it is depressed and released;

(d) a base containing a source of illumination for fully lighting said pushbutton target system and any halo and containing one or more microswitches; and (e) wherein said inclined inner surface area of said mounting ring of said button body housing limits travel of the outer inclined surface area of said pushbutton target to allow it to just operate said one or more microswitches; wherein the only contact between the pushbutton target system and the mounting ring is through the matching inclined surfaces.

2. A pushbutton switch assembly as in claim 1 comprising a plurality of microswitches.

3. A pushbutton switch assembly as in claim 1 wherein components limiting the travel of said pushbutton comprise stainless steel.

4. A pushbutton switch assembly as in claim 1 wherein interacting surfaces of said button body housing and said pushbutton target system are stainless steel, any excessive force being distributed and dissipated through stainless steel components and a mounting panel.

5. A pushbutton switch assembly as in claim 4 wherein said button body housing includes a halo.

6. A pushbutton switch assembly as in claim 1 wherein said source of illumination is at least one LED device.

7. A pushbutton switch assembly as in claim 6 wherein said source of illumination is a plurality of LED devices.

8. A pushbutton switch assembly as in claim 7 wherein said button body housing includes a halo.

* * * * *